US009650869B2

(12) United States Patent
Wilson et al.

(10) Patent No.: US 9,650,869 B2
(45) Date of Patent: May 16, 2017

(54) WELL SHUT IN DEVICE

(71) Applicant: Wireless Measurement Limited, Hampshire (GB)

(72) Inventors: James Wilson, Hampshire (GB); Eric Atherton, Witney (GB)

(73) Assignee: Wireless Measurement Limited, Hampshire (GB)

( * ) Notice: Subject to any disclaimer, the term of this patent is extended or adjusted under 35 U.S.C. 154(b) by 350 days.

(21) Appl. No.: 14/268,034

(22) Filed: May 2, 2014

(65) Prior Publication Data

US 2014/0238658 A1 Aug. 28, 2014

Related U.S. Application Data

(63) Continuation of application No. PCT/EP2012/071753, filed on Nov. 2, 2012.

(30) Foreign Application Priority Data

Nov. 4, 2011 (GB) ..... 1119104.6

(51) Int. Cl.
*E21B 34/16* (2006.01)
*G08C 17/02* (2006.01)
*E21B 34/08* (2006.01)

(52) U.S. Cl.
CPC ..... *E21B 34/16* (2013.01); *E21B 34/08* (2013.01); *G08C 17/02* (2013.01); *G08C 2201/20* (2013.01)

(58) Field of Classification Search
CPC ..... G08C 17/02; G08C 2201/20; E21B 34/16; E21B 34/08; E21B 34/10
See application file for complete search history.

(56) References Cited

U.S. PATENT DOCUMENTS 4,062,379 A * 12/1977 Clinton ..... E21B 34/16 137/565.14
4,667,736 A 5/1987 Rumbaugh et al. ..... 166/66.6
(Continued)

OTHER PUBLICATIONS

GB Search Report, GB1119104.6; dated Nov. 21, 2011. 1 page.
International Searching Authority—EPO, International Search Report, PCT/EP2012/071753; dated Oct. 21, 2013. 10 pages.

*Primary Examiner* — Brad Harcourt
(74) *Attorney, Agent, or Firm* — Sunstein Kann Murphy & Timbers LLP

(57) ABSTRACT

An arrangement for extraction of hydrocarbons includes a flow conduit that leads from a subsurface region to an above-surface region. A normally-closed shut-in valve is located in the subsurface region of the flow conduit. A hydraulic system is arranged to cause the shut-in valve to open when the hydraulic system is pressurized. A release valve releases pressure in the hydraulic system. A wireless interface having a unique identifier is adapted to open the release valve on receipt of a wireless communication from a remote device. A plurality of remote devices each include a wireless transmitter that is compatible with the wireless interface and able to transmit control instructions to the wireless interface. At least one control instruction in any sequence of control instructions is issued by the remote device including the unique identifier. The wireless interface is adapted to ignore control instructions containing an identifier differing from the unique identifier.

14 Claims, 3 Drawing Sheets

(56) References Cited

U.S. PATENT DOCUMENTS

| | | | | |
|---|---|---|---|---|
| 4,722,393 | A | 2/1988 | Rumbaugh et al. | 166/217 |
| 4,781,607 | A | 11/1988 | Rumbaugh et al. | 439/191 |
| 2005/0115619 | A1* | 6/2005 | Kawulka | E21B 33/0355 137/625.33 |
| 2008/0129445 | A1* | 6/2008 | Kraimer | B66F 9/07581 340/5.2 |
| 2009/0223670 | A1* | 9/2009 | Snider | E21B 23/00 166/308.1 |
| 2010/0147511 | A1* | 6/2010 | Ollre | E21B 47/0007 166/250.01 |
| 2012/0031494 | A1* | 2/2012 | Lymberopoulos | E21B 47/12 137/1 |

* cited by examiner

WELL SHUT IN DEVICE

This application is a continuation of Patent Cooperation Treaty Application PCT/EP2012/071753, filed Nov. 2, 2012, which in turn claims priority from Great Britain Patent Application GB 1119104.6, filed Nov. 4, 2011, which are incorporated herein by reference in their entireties.

FIELD OF THE INVENTION

The present invention relates to a well shut-in device.

BACKGROUND ART

Effective Oil and Gas well control is an important element of safety in the hydrocarbons industry. In recent times, subsurface shut in valves have become common additional well control devices.

Subsurface shut in valves are located some distance below the wellhead, and are designed to close (or be closed) in the event of an emergency, thus shutting the well in and preventing further flow of hydrocarbons. They are located at a sufficient depth that accidental damage or deliberate sabotage to the wellhead will leave the subsurface shut in valve intact, and able to stop the dangerous uncontrolled flow of hydrocarbons to the surface. In addition to being an extreme hazard, uncontrolled flow of hydrocarbons causes significant environmental damage and economic loss.

Subsurface shut in valves are designed to "fail safe", meaning that they are naturally biased (using springs or hydraulic accumulators) to close. They are usually hydraulically actuated, held in the open position by an actuator supplied with pressurised fluid down a tube ("line") from the surface. This line runs up to a pressure control panel on the surface, and a manual emergency shut in valve, that when activated, releases the hydraulic pressure and so shuts in the well.

For safety reasons, the manual hydraulic shut in valve (and the pressure control panel) is often located some distance from the well, so that if the well is on fire then the manual emergency shut in valve can still be activated. For the same reason, the manual emergency shut in valve is generally located in a direction that is upwind in the prevailing wind.

SUMMARY OF THE INVENTION

There remain certain wellhead emergencies that present an extreme danger, such as the release of gas or poisonous gas, extreme wellhead fires, and wellhead fires when the wind is not in its usually prevailing direction. In such cases, it is still extremely hazardous to approach the well close enough to activate the manual emergency shut in valve.

According to the present invention, an additional way is provided of actuating the shut-in valve (such as by venting the hydraulic pressure in the hydraulic control tubing). This is typically located close to the manual emergency shut in valve, but may be activated by a remote handheld radio controller.

The handheld radio controller may preferably contain a display and directional antenna, so that feedback from the well may be displayed, and the correct well to shut in may be selected from a cluster of wells within radio range.

Thus, in a first aspect the present invention provides a well for extraction of hydrocarbons, and an associated control system, comprising a flow conduit for the hydrocarbons leading from a subsurface region to an above-surface region, a normally-closed shut-in valve located in the subsurface region of the flow conduit, a hydraulic system arranged to cause the shut-in valve to open when the hydraulic system is pressurised, and a release valve for releasing pressure in the hydraulic system, a wireless interface having a unique identifier, and being adapted to open the release valve on receipt of a wireless communication from a remote device, and a plurality of remote devices, each comprising a wireless transmitter compatible with the wireless interface and able to transmit control instructions and/or an enquiry signal not containing any unique identifier to the wireless interface, at least one control instruction in any sequence of control instructions issued by the remote device including the unique identifier, wherein the wireless interface is adapted to ignore control instructions containing an identifier differing from the unique identifier and to respond to an enquiry signal by reporting the unique identifier to the or each remote device.

This permits the well to be deactivated without having to approach the manual shut-in valve. As noted above, in some circumstances it is dangerous to do so. The present invention therefore allows that risk to personnel to be avoided and for the well to be made safe before it is approached.

This can be in addition to the manual release valve for releasing pressure in the hydraulic system.

A pressure sensor can be provided in the hydraulic system, to detect the pressure of the hydraulic fluid in the hydraulic system. The wireless interface is preferably adapted to transmit data relating to this detected pressure. We also prefer that the flow conduit includes a flow rate sensor, such as a pair of pressure sensors either side of a choke, and that the wireless interface is adapted to transmit data relating to this detected flow rate (either as a flow rate or as the individual pressures). The remote device can then comprise a display output, and display via the display output the data transmitted by the wireless interface. This provides a clear form of feed-back to the operator. After operating one or more controls on the remote device, and thus causing a wireless communication to be sent to the well, to cause the well to open the release valve, the operator can see at least one of a reduction in the pressure in the hydraulic system and/or a reduction in the flow rate from the well, indicating that the shut-in valve has been actuated and that it is safe to approach the well.

In a further aspect, the present invention provides a well control system, comprising a normally-closed shut-in valve for installation into a flow conduit of a well, a hydraulic system for connection to the shut-in valve, adapted when so connected to open the shut-in valve when the hydraulic system is pressurised, also comprising a release valve for releasing pressure in the hydraulic system, a wireless interface having a unique identifier, and being adapted to open the release valve on receipt of a wireless communication from a remote device, a plurality of remote devices, each comprising a wireless transmitter compatible with the wireless interface and able to transmit control instructions and/or an enquiry signal not containing any unique identifier to the wireless interface, at least one control instruction in any sequence of control instructions issued by the remote device including the unique identifier, wherein the wireless interface is adapted to ignore control instructions containing an identifier differing from the unique identifier and to respond to an enquiry signal by reporting the unique identifier to the or each remote device.

In a still further aspect, the present invention provides a well control system for a well comprising a normally-closed shut-in valve controlled by a hydraulic system, comprising a release valve for installation into the hydraulic system, adapted to release pressure in the hydraulic system when opened, a wireless interface having a unique identifier, and being adapted to open the release valve on receipt of a wireless communication from a remote device, a plurality of remote devices, each comprising a wireless transmitter compatible with the wireless interface and able to transmit control instructions and/or an enquiry signal not containing any unique identifier to the wireless interface, at least one control instruction in any sequence of control instructions issued by the remote device including the unique identifier, wherein the wireless interface is adapted to ignore control instructions containing an identifier differing from the unique identifier and to respond to an enquiry signal by reporting the unique identifier to the or each remote device.

Such well control systems can be fitted to existing wells, or to existing wells already provided with shut-in valves, in order to allow remote operating in the manner described above. As with the first aspect of the invention, the wireless interface can be adapted to transmit at least one operating parameter from the well, and the remote device preferably has a display output via which it displays the operating parameter transmitted by the wireless interface. The operating parameter can be a hydraulic pressure, or a flow rate, or one or more pressures around a choke that indicate a flow rate, or another parameter.

In any of the above aspects, the plurality of remote devices ideally include a directional antenna for communicating with the wireless interface. This will assist the operators in identifying the correct well. Such wells are often installed in groups, and a directionality in the remote device's sensitivity will ensure that the correct well is selected. To assist further in this regard, the plurality of remote devices are adapted to send an enquiry signal not containing any unique identifier, and can display a list of all wireless interfaces that respond, ideally in signal strength order.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1:
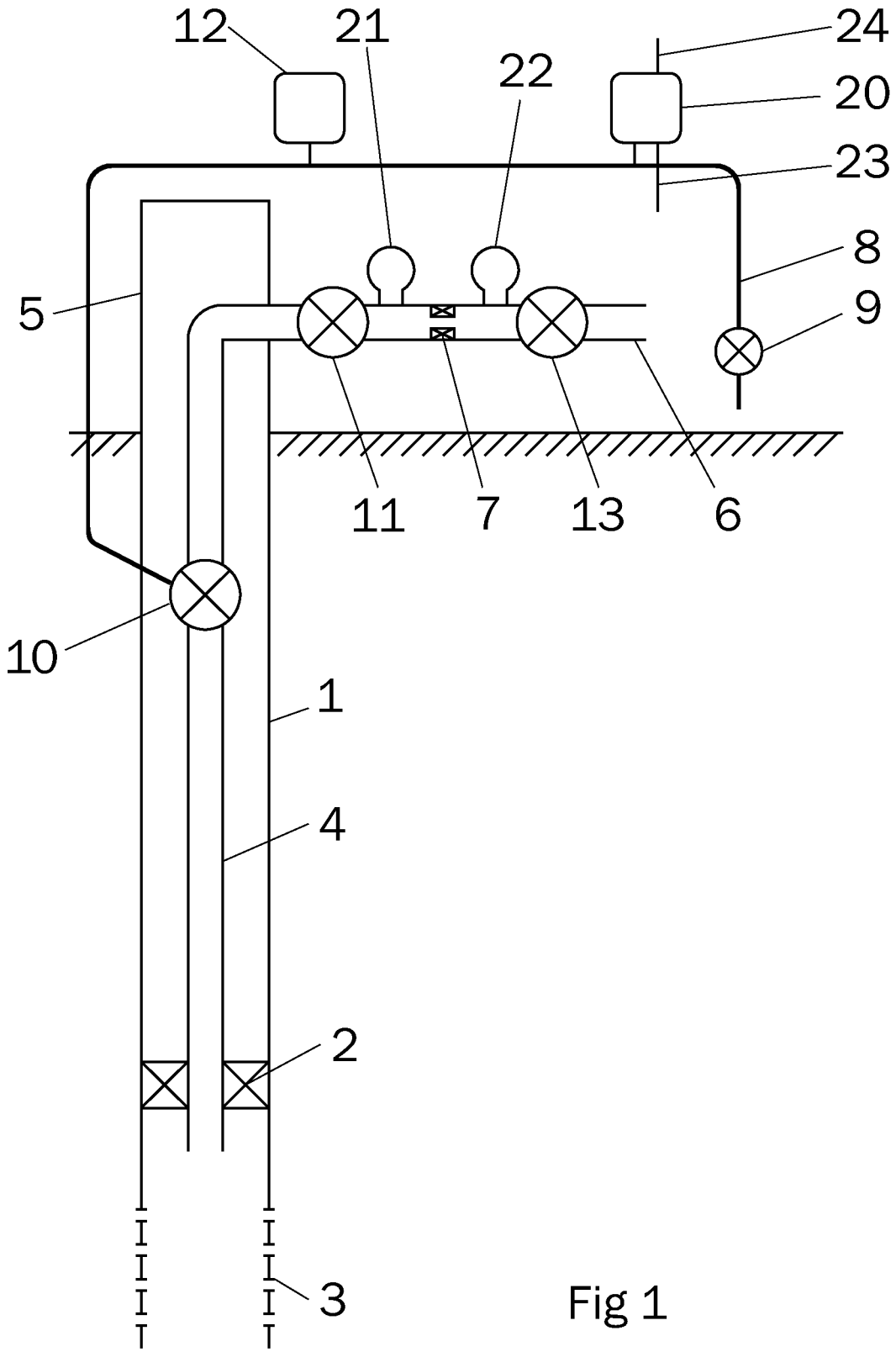
FIG. 1 shows a general schematic layout of a well and its associated shut-in valve according to the present invention.

Referring to FIG. 1, a well casing 1 contains perforations 3 that allow hydrocarbons to enter the well casing 1 and flow through production tubing 4 to the surface, via a sub surface shut in valve 10. A production packer 2 prevents hydrocarbons flowing to the surface in the annular region between the production tubing 4 and the well casing 1. Hydrocarbon flow in the production tubing 4 passes through manual shut in valve 11, choke 7, and manual shut in valve 13, before reaching the flow line 6 which conveys hydrocarbons to a remote processing facility (not shown in the figures).

The manual shut in valves 11 and 13 are located on the surface, and allow manual shutting in of the well. The sub-surface shut in valve 10 is naturally biased in a "closed" position, but is held open by the pressurised fluid in hydraulic control tubing 8. The manual emergency shut in valve 9 acts by venting the fluid in the hydraulic control tubing 8 when this manual control valve 9 is operated, thus allowing the subsurface shut in valve 10 to close and hence shut in the well. To re-establish well flow after the manual emergency shut in valve 9 has been activated, pressure control panel 12 is used to pump hydraulic fluid into the hydraulic control tubing 8 and hence open sub surface shut in valve 10. This is a useful form of failsafe; if much or all the surface equipment is destroyed, then the hydraulic line 8 will be ruptured and the hydraulic pressure will be lost causing the shut-in valve to close.

The choke valve 7 contains a calibrated orifice that is designed to set the flow of the well to a reasonable level when all the valves 11, 13 and 10 are fully open. Pressure is monitored upstream of choke 7 by wireless pressure sensor 21. Pressure is monitored downstream of choke 7 by wireless pressure sensor 22. The pressure drop across the choke gives a measure of well flow rate. For the purposes of this example, the wireless pressure sensors are as set out in our earlier patent application published as WO 2007/085850, and are therefore able to report the sensed pressures back to a central monitoring station or other network-enabled device via a resilient and flexible networking arrangement.

A wireless control panel 20 provides an additional means of activating the sub surface shut in valve 10, by venting the fluid in hydraulic control tubing 8 to a vent tube 23 on receipt of an appropriate command via an antenna 24.

Figure 2:
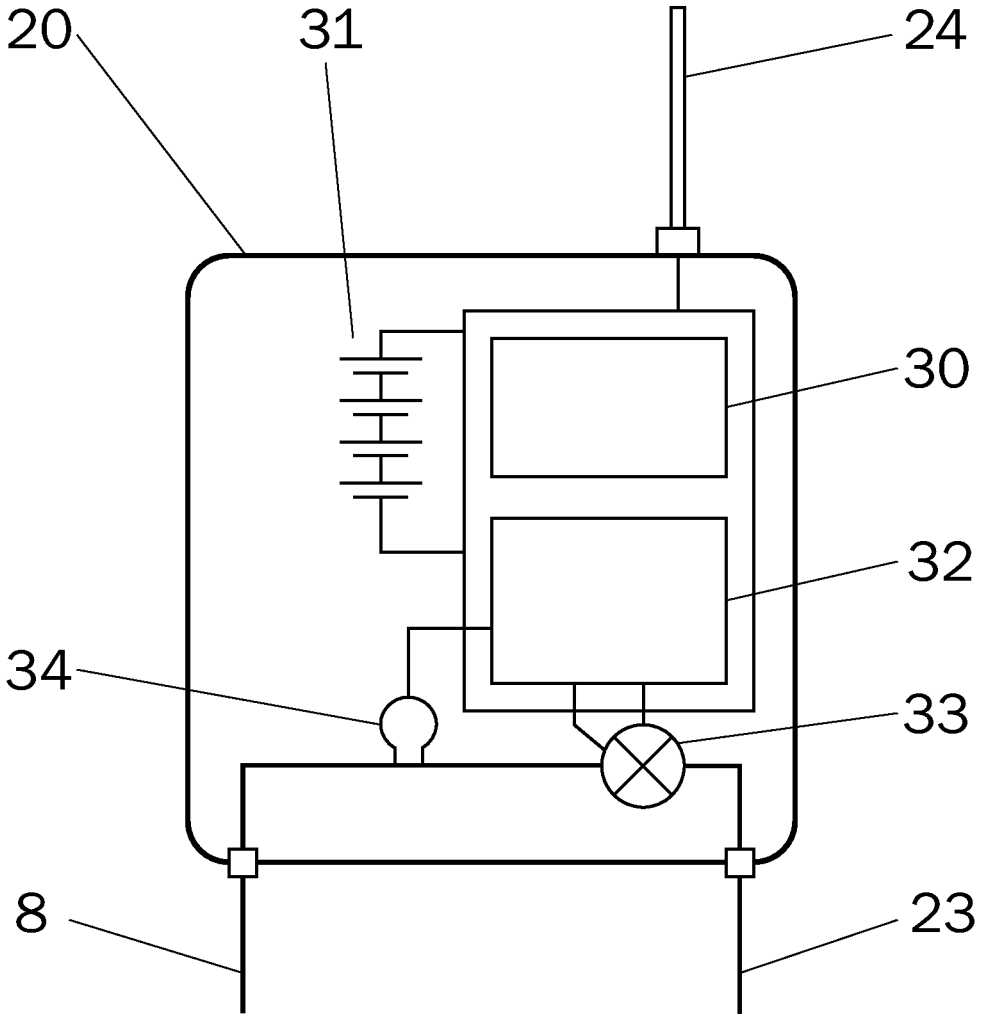
FIG. 2 shows the wireless control panel of FIG. 1 in more detail.

The wireless control panel 20 is shown in more detail in FIG. 2. Wireless control panel 20 communicates with a handheld controller 40, shown in FIG. 3, which is used by well operations staff to shut the well in from a safe distance prior to approaching a well that is suspected of being in a hazardous condition. The well may be approached from the current upwind direction, thus minimising the risk of entering a gas plume that is emanating from the well.

Figure 3:
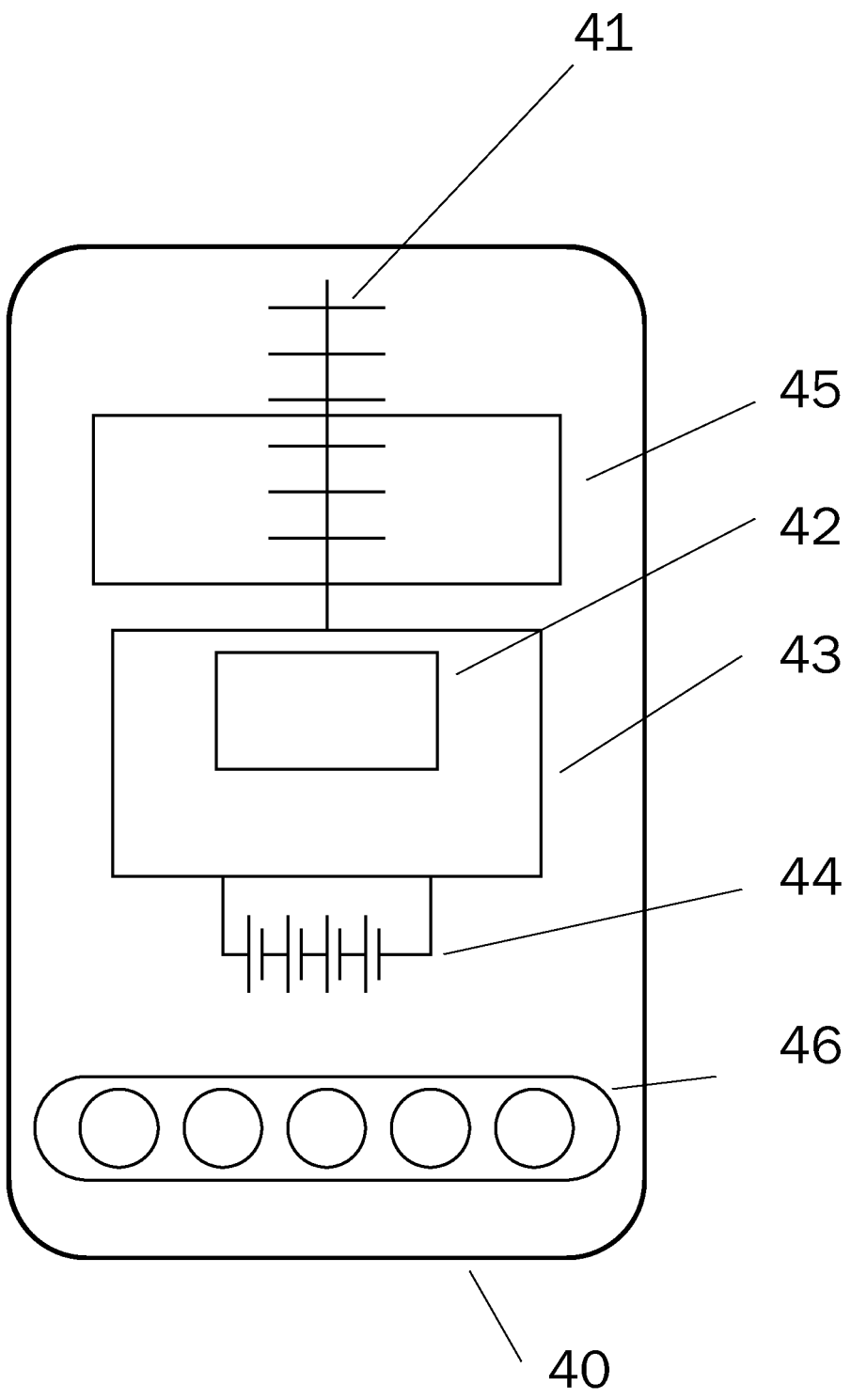
FIG. 3 shows the remote transmitter unit of the present invention.

Referring to FIG. 3, a battery pack 44 supplies power to a controller 43, radio 42, and electronic display 45. While still a safe distance from the well, well operations staff request a "scan" of all the nearby wells using keypad 46. The directional antenna 41 (such as a yagi antenna or a triple folded dipole antenna), which is mounted inside handheld controller 40 for convenience and ruggedness, enables the well operations staff to select the general direction of the well by pointing the handheld controller, 40, in the required direction. After the "scan", handheld controller 40 displays a list of wells on the electronic display 45, in order of radio signal strength (which broadly depends on both proximity and direction). The well operations staff may then select the desired well, and send the "shut in" command to just this well. At this point, the handheld controller receives feedback from the selected well, and displays the feedback parameters on the electronic display 42. Feedback parameters include hydraulic pressure in the hydraulic control tubing 8, upstream pressure from wireless pressure sensor 21, and downstream pressure from wireless pressure sensor 22.

In the event of correct actuation of the sub surface shut in valve 10, the well operations staff will be able to observe the bleeding away of pressure in the hydraulic control tubing 8 down to atmospheric pressure, and the upstream pressure provided by wireless pressure sensor 21 (via control panel 20) reducing as the well is shut in, ultimately approaching the downstream pressure provided by sensor 22 via control panel 20, as flow across the choke valve 7 is reduced to zero. By observing these feedback parameters, the well operations staff are provided with a high degree of confidence that not only has the hydraulic fluid in control tubing 8 been vented by control panel 20, but also that the sub surface shut in valve 10 has operated correctly and shut in the well.

Referring to FIG. 2, the antenna 24 is designed to communicate with both the wireless pressure sensors 21 and 22 and the handheld controller 40.

Once the controller receives a "scan request" from the handheld controller 40, it responds with its well identification. It then proceeds to collect pressure information from the two wireless pressure sensors 21 and 22, and also pressure sensor 34 that measures the pressure in the hydraulic control tubing 8. If controller 32 then receives a "select" command, it responds immediately with the three feedback parameters, pressures from wireless sensors 21 and 22 and pressure from pressure sensors 34. If controller 32 then receives a "shut in" command from the remote handheld controller 40 it continues to send the feedback parameters on a regular basis, and also proceeds to activate electrically operated hydraulic valve 33 which allows fluid from inside hydraulic control tubing 8 to be vented via vent tubing 23. The controller 32 continues to send the set of feedback parameters (the two pressures from the well, and the hydraulic control tubing pressure) to the handheld controller 40.

Battery 31 provides power to the radio 30 and controller 32, and is of sufficient capacity to provide long term reliable operation of the control panel 20.

Typically, an oilfield will have multiple wells, and multiple service crews, vehicles, and supervisors (who may be operating in parallel or on different shifts etc). Thus, there is a need for multiple remote handheld controller devices, such as one per field service vehicle and one issued personally to each supervisor. In practice, field service crew will be alerted to a problem on a particular well number and asked to deal with it. They will take the most conveniently available handheld controller and travel to the general vicinity of the well (albeit at a safe distance). The sequence of operations will then be:

a. Ask all wells within range to report their ID. If field service crew knows the approximate direction of the well, they can point the antenna in that direction.

b. Review the list of wells that have responded. They are listed on the display of the handheld controller, sorted in order of signal strength for convenience of selection. Typically, the well required will be in the top few items on the list, especially if the field service crew have been able to orient the handheld controller toward the well in question.

c. Select the well required. This well is now "selected" on this remote device, and further commands sent by this remote device will have this well's unique identifier attached, so that the selected well (and no others) will respond.

d. Command the selected well to respond with its "feedback parameters" (hydraulic pressure, well pressures if available etc). These pressures should now be regularly sent by the well until further notice.

e. Command the selected well to shut in.

f. The field service crew can then continue to monitor feedback pressures until they are satisfied that the well is safe to approach.

The handheld controller therefore obtains its list of wells from the details of which wells respond to the initial query (step (a)). It is highly advantageous that the handheld controller does not need to store a list of wells in the field; to have such a list means that many remote devices have to be reliably and consistently updated with new well numbers whenever an well in the field is changed or added. It is highly likely that, from time to time, this will not happen—in which case a field crew will be unable to shut in all the wells in a particular field. The present invention eliminates the need for this internal list, because each remote handheld controller device asks the wells within range for their identifiers. The directional antenna, and the listing by signal strength both facilitate this approach.

A further benefit of the directional antenna and the monitoring of well signal strength is that the handheld controller may be used as a well locator, for example, when visibility is very poor. This can be a common occurrence in oil field conditions, where sandstorms, fog, driving rain, jungle or forest terrain are common. Alternatively, the device can be used as a position finder; a field service crew unsure of their location can scan to see which wells are close by, and then look at oilfield map to determine their approximate location.

Examples of the signals exchanged between the handheld controller (HH) and the well are as follows. When a crew presses "scan", the controller transmits a 6 second continuous tone. This will, incidentally, block transmissions from any other handheld controllers in the vicinity which may help alert the service crews that another crew is working nearby.

Thus, the first transmission is:

1) HH SCAN: 6 second continuous transmission to wake up receivers " . . . "

This does not include any unique identifier associated with any particular well (or, rather, a wireless interface associated with a specific well). Therefore, none of the wireless interfaces of any wells will filter out the signal, and all will respond. To avoid collisions, the wireless interfaces are programmed to respond after a short random delay:

2) WELLs: random time after tone end "To HH SCAN: HELLO:From XXX"

where XXX is replaced by the ID number or code of the well in question. The Handheld controller then builds up a list of the wells within range from the received HELLO messages. The user can then pick a specific well, and ask for the well parameters to be displayed:

3) HH transmits "To XXX:QUERY XYZ:From HH"

where XYZ is the pre-programmed code for a specific parameter or group of parameters. All wells other than well XXX will then filter out or otherwise ignore this message, but well XXX will respond with the requested data:

4) XXX replies "To HH:XYZ=abc:From XXX"

The user can thus confirm that they are in the vicinity of the correct well and that it is currently operational (as indicated by the transmitted parameters). The user can then issue a shut-in command to deactivate the well and make it safe to approach:

5) HH transmits "To XXX:SHUT IN:From HH"

6) XXX replies "To HH:SHUT IN CONFIRM?: From XXX"

7) HH replies "To XXX:SHUT IN CONFIRM EXECUTE:From HH"

The well then opens the bleed valve to release the hydraulic pressure that is keeping the shut-in valve open, thereby closing the shut-in valve.

It is possible to shorten the messages, if needed, by allowing for more than one mode to be adopted by the wireless controllers. For example, a message sequence could be:

1) Handheld: Which wells are out there?

2) Wells: Each respond with their identifiers

This query message would be the only thing that wells would respond to when in their "standard mode", according to this scheme. If the user of the handheld device then selected well number 128 for example) for shutdown, it could then transmit a message which meant:

3) Handheld: Number 128 you are now enabled to receive and respond to commands for 30 minutes, after which revert to standard mode This would then place well 128 in a "command mode" in which it responds to all instructions, not just a query message. As a result, the handheld device can transmit:

4) Handheld: Report pressures until further notice or

5) Handheld: Shut in the well and the only well to respond will be well 128, as all other wells within range will be in "standard mode". To end the session, the handheld device can transmit:

6) Enter standard mode

The above sequence will work (although may not be optimal from other perspectives) with only one command that includes a unique identifier. As a result, the commands can be made much shorter. Although presented in natural language above, they would in practice be represented by suitable code sequences.

Thus, the present invention provides a reliable and resilient means for shutting-in wells from a safe distance, giving field service crews confidence that the well has in fact been shut in properly. It will of course be understood that many variations may be made to the above-described embodiment without departing from the scope of the present invention.

The invention claimed is:

1. A well for extraction of hydrocarbons, and an associated control system, comprising;

a flow conduit for the hydrocarbons leading from a subsurface region to an above-surface region, a normally-closed shut-in valve located in the subsurface region of the flow conduit, a hydraulic system arranged to cause the shut-in valve to open when the hydraulic system is pressurised, and a release valve for releasing pressure in the hydraulic system, a wireless interface having a unique identifier, and being adapted to open the release valve on receipt of a wireless communication from a remote device, and a plurality of remote devices, each comprising a wireless transmitter compatible with the wireless interface and able to transmit control instructions and an enquiry signal not containing any unique identifier to the wireless interface when the device is remote from the well, at least one control instruction in any sequence of control instructions issued by the remote device including the unique identifier;

wherein the wireless interface is adapted to ignore control instructions containing an identifier differing from the unique identifier and to respond to an enquiry signal by reporting the unique identifier to the or each remote device, and wherein the plurality of remote devices are adapted to display a list of all wireless interfaces that respond to an enquiry signal not containing any unique identifier.

2. A well and associated control system according to claim 1 further comprising a manual release valve for releasing pressure in the hydraulic system in addition to the release valve.

3. A well and associated control system according to claim 1 further comprising a pressure sensor adapted to detect the pressure in the hydraulic system.

4. A well and associated control system according to claim 3 in which the wireless interface is adapted to transmit data relating to the detected pressure.

5. A well and associated control system according to claim 1 in which the flow conduit includes a flow rate sensor.

6. A well and associated control system according to claim 5 in which the flow rate sensor comprises a pair of pressure sensors either side of a choke.

7. A well and associated control system according to claim 5 in which the wireless interface is adapted to transmit data relating to the detected flow rate.

8. A well and associated control system according to claim 7;

the remote device comprising at least one control and having a display output, and being arranged to:

i. send a wireless communication to cause the well to open the release valve when the control is actuated, and ii. display via the display output data transmitted by the wireless interface.

9. A well and associated control system according to claim 1 in which the plurality of remote devices each include a directional antenna for communicating with the wireless interface.

10. A well control system, comprising:

a normally-closed shut-in valve for installation into a flow conduit of a well, a hydraulic system for connection to the shut-in valve, adapted when so connected to open the shut-in valve when the hydraulic system is pressurised, also comprising a release valve for releasing pressure in the hydraulic system, a wireless interface having a unique identifier, and being adapted to open the release valve on receipt of a wireless communication from a remote device, a plurality of remote devices, each comprising a wireless transmitter compatible with the wireless interface and able to transmit control instructions and an enquiry signal not containing any unique identifier to the wireless interface when the device is remote from the well, at least one control instruction in any sequence of control instructions issued by the remote device including the unique identifier;

wherein the wireless interface is adapted to ignore control instructions containing an identifier differing from the unique identifier and to respond to an enquiry signal by reporting the unique identifier to the or each remote device, and wherein the plurality of remote devices are adapted to display a list of all wireless interfaces that respond to an enquiry signal not containing any unique identifier.

11. A well control system for a well comprising a normally-closed shut-in valve controlled by a hydraulic system, comprising:

a release valve for installation into the hydraulic system, adapted to release pressure in the hydraulic system when opened;

a wireless interface having a unique identifier, and being adapted to open the release valve on receipt of a wireless communication from a remote device a plurality of remote devices, each comprising a wireless transmitter compatible with the wireless interface and able to transmit control instructions and an enquiry signal not containing any unique identifier to the wireless interface when the device is remote from the well, at least one control instruction in any sequence of control instructions issued by the remote device including the unique identifier;

wherein the wireless interface is adapted to ignore control instructions containing an identifier differing from the unique identifier and to respond to an enquiry signal by reporting the unique identifier to the or each remote device, and wherein the plurality of remote devices are adapted to display a list of all wireless interfaces that respond to an enquiry signal not containing any unique identifier.

12. A well control system according to claim 11, wherein the wireless interface is adapted to transmit at least one operating parameter from the well, and the remote device has a display output, via which it displays the operating parameter transmitted by the wireless interface.

13. A well control system according to claim 12 in which the plurality of remote devices each include a directional antenna for communicating with the wireless interface.

14. A well control system according to claim 12, in which the plurality of remote devices are adapted to display the list in signal strength order.

* * * * *